US008342390B2

(12) United States Patent
Potter et al.

(10) Patent No.: US 8,342,390 B2
(45) Date of Patent: Jan. 1, 2013

(54) DELIVERY CONTAINER FOR DIGITAL DISC

(75) Inventors: Thomas C. Potter, Oak Hill, VA (US); Christopher M. Stratton, Springfield, VA (US); Hernan A. Borja, Bealeton, VA (US); Nan K. McKenzie, Garrett Park, MD (US)

(73) Assignee: United States Postal Service, Washington, DC (US)

( * ) Notice: Subject to any disclaimer, the term of this patent is extended or adjusted under 35 U.S.C. 154(b) by 313 days.

(21) Appl. No.: 12/856,880

(22) Filed: Aug. 16, 2010

(65) Prior Publication Data

US 2011/0079638 A1 Apr. 7, 2011

Related U.S. Application Data

(63) Continuation-in-part of application No. 10/953,452, filed on Sep. 30, 2004, now Pat. No. 7,798,392.

(60) Provisional application No. 60/511,636, filed on Oct. 17, 2003.

(51) Int. Cl.

| | |
|---|---|
| ***B65D 27/06*** | (2006.01) |
| ***B65D 27/34*** | (2006.01) |
| ***B65D 27/00*** | (2006.01) |
| ***B65D 85/30*** | (2006.01) |

(52) U.S. Cl. ..... 229/305; 229/313; 229/70; 206/308.1

(58) Field of Classification Search ..... 229/300–306, 229/313, 92.1–92.3, 70; 206/308.1
See application file for complete search history.

(56) References Cited

U.S. PATENT DOCUMENTS

| | | | | |
|---|---|---|---|---|
| 1,957,704 | A | 5/1934 | Drachman | |
| 2,675,170 | A * | 4/1954 | Sebesta | 235/489 |
| 2,686,005 | A | 8/1954 | Hyman | |
| 3,312,385 | A * | 4/1967 | Amort | 229/69 |
| 3,999,700 | A | 12/1976 | Chalmers | |
| 4,201,332 | A * | 5/1980 | Wooten | 229/92 |
| 4,473,153 | A | 9/1984 | Colangelo | |
| 4,778,100 | A * | 10/1988 | McGuire et al. | 229/303 |
| 4,905,831 | A | 3/1990 | Bagdis et al. | |
| 5,676,466 | A | 10/1997 | Lindenbeck | |
| 5,826,914 | A * | 10/1998 | Hudetz | 283/61 |
| 6,152,357 | A * | 11/2000 | Schnitzer | 229/74 |
| 6,230,964 | B1 | 5/2001 | Saito | |

(Continued)

FOREIGN PATENT DOCUMENTS

JP 07041002 A * 2/1995

(Continued)

OTHER PUBLICATIONS

International Search Report (PCT) and Written Opinion of the International Searching Authority for International Application No. PCT/US04/31952, dated Jan. 11, 2005.

*Primary Examiner* — Jes F Pascua
(74) *Attorney, Agent, or Firm* — Finnegan, Henderson, Farabow, Garrett & Dunner, L.L.P.

(57) ABSTRACT

Two-way disc mailers for mailing DVDs, CDs, video game discs, or other discs from a sender to a recipient via first class mail. The disc mailer provides improved automated mail processing while weighing less than or equal to 1 ounce, including the weight of the disc.

33 Claims, 4 Drawing Sheets

U.S. PATENT DOCUMENTS

| | | | | |
|---|---|---|---|---|
| 6,283,362 | B1 * | 9/2001 | Michlin | 229/70 |
| 6,612,484 | B2 * | 9/2003 | Rawlings et al. | 229/305 |
| 6,634,493 | B2 * | 10/2003 | Exline | 206/232 |
| 6,644,538 | B1 * | 11/2003 | Schnitzer | 229/74 |
| 6,796,424 | B2 * | 9/2004 | Exline | 206/232 |
| 6,966,484 | B2 | 11/2005 | Calonje et al. | |
| 7,044,293 | B2 * | 5/2006 | Exline | 206/232 |
| 7,156,288 | B2 * | 1/2007 | Liddell | 229/313 |
| 7,798,392 | B2 * | 9/2010 | Potter et al. | 229/305 |
| 2002/0020642 | A1 | 2/2002 | Langerak | |
| 2003/0001380 | A1 * | 1/2003 | Stewart | 283/60.1 |
| 2003/0102364 | A1 | 6/2003 | Juliao et al. | |
| 2003/0121962 | A1 | 7/2003 | Hamblin | |

FOREIGN PATENT DOCUMENTS

| | | | |
|---|---|---|---|
| JP | 10181748 | A * | 7/1998 |
| WO | WO 0236448 | A1 | 5/2002 |

* cited by examiner

DELIVERY CONTAINER FOR DIGITAL DISC

RELATED APPLICATIONS

This is a continuation-in-part of U.S. patent application Ser. No. 10/953,452, filed Sep. 30, 2004 now U.S. Pat. No. 7,798,392, which is related to and claims priority of U.S. Provisional Application No. 60/511,636 entitled "Disc Mailer" filed Oct. 17, 2003. Both applications are incorporated herein by reference in their entirety.

TECHNICAL FIELD

This invention relates to two-way delivery containers for discs such as compact discs ("CDs"), video game discs, or digital video discs ("DVDs").

BACKGROUND

Envelopes for shipping discs containing digital data are conventionally known and are sometimes referred to as "disc mailers," even though the shipping may be provided by various delivery service providers. Conventional disc mailers have several drawbacks. For example, some conventional disc mailers do not adequately protect discs during the mailing process, resulting in lost, damaged, or stolen discs. Other conventional disc mailers may exceed certain shipping weight limitations—when weighed with the disc—resulting in increased shipping costs. Other conventional disc mailers use paper that is too flexible, thus resulting in automated processing difficulties and associated delayed processing times, particularly on the return trip of a two-way disc mailer.

A two-way disc mailer is designed for shipping a disc via a delivery service to a first recipient and later permitting the first recipient to forward the disc to a second recipient. Two-way disc mailers are popular among DVD rental companies who provide a customer with a rental disc for the customer's viewing, along with a mailer to send the disc back to the rental company.

In one example of a shipping weight limitation, for first-class United States Postal Service ("USPS") postage, the weight of the two-way disc mailer, with the enclosed disc, must be equal to or less than 1 ounce. The weight of a DVD is approximately 0.62 ounce, which is slightly heavier than the weight of a CD. As a result, the weight of a disc mailer being processed and shipped via USPS first-class mail is preferably less than or equal to about 0.38 ounce.

Most delivery items are processed automatically. For automatic processing by the USPS, for example, the dimension of the mailpiece must comply with the USPS aspect ratio regulation. The aspect ratio is expressed as a ratio of length (the direction parallel to the address) divided by height. For example, a postcard 140 mm long by 89 mm high has an aspect ratio of 1.57. An aspect ratio of between 1.3 and 2.5, inclusive, is required for existing USPS automation compatibility. Because discs have a diameter of approximately 120 mm, the height of the disc mailer must be greater than 120 mm, and the length must therefore be greater than 156 mm, to comply with the minimum aspect ratio requirement. As a result, at least 36 mm of length of the disc mailer does not house the disc and may become bent or folded during mail processing, possibly covering the information required for processing, resulting in unnecessary delays. Consequently, it is desirable for the disc mailer to be constructed of material that is less susceptible to bending, while still conforming with the first-class postage weight limitations.

Another aspect of delivery item processing is "cancellation," which can possibly damage the disc enclosed in the mailer. Cancellation involves marking the mailpiece with a mark, such as a postmark that contains the post office name, state, ZIP code, and month, day, and year that the delivery item was canceled. The Advanced Facer Canceller System ("AFCS") is the primary letter canceling machine used in USPS processing and distribution centers. If during cancellation, the canceling machine strikes the portion of the mailer containing the disc, the disc may be damaged. Generally, the mailpiece is struck anywhere in the area from about 30 mm from the top of the mailpiece, to about 100 mm from the right edge of the mailpiece. Accordingly, it is desirable to locate (that is, position and retain) the disc within the mailer to an area away from where cancellation strike may occur.

Further, during processing, some delivery items are marked with a unique identification tag ("ID tag") so that they can be identified and sorted correctly. The ID tag may be machine-readable and improves both tracking and processing of the marked mail piece. For two-way disc mailers, the ID tag from the initial outbound shipment must not be visible on the return envelope during the second processing. If the ID tag from the initial outbound mailing is visible on the return envelope, the delivery item may be delayed during return processing.

Also during processing, the AFCS orients the delivery item with the length side facing up and the short side substantially vertical. As the delivery item is fed through the AFCS, it is transported by belts and pulleys throughout the system. These belts and pulleys apply a frictional force to the delivery item that is substantially parallel to its length. As a result, this frictional force can have the undesirable consequence of inadvertently opening conventional disc mailers that are not completely bound along their length. Accordingly, if the disc mailer comprises a folded flexible sheet of material, it is desirable to locate the folds along the length of the mail piece in order to prevent the AFCS from inadvertently opening or damaging the disc mailer. It may also be desirable to locate the direction of grain of the folded material so that the folds are substantially parallel to the grain, thus minimizing the chance the flexible sheet will tear along the folds.

Additionally, because of the required aspect ratio for mail pieces, the disc in a two-way disc mailer with top and bottom sides not completely bound along its entire length may be vulnerable to theft. The disc in this type of conventional mailer may be manipulated out of the mailer without tearing the envelope. Accordingly, locating the folds of a two-way disc mailer along the length-side of the mail piece advantageously provides improved theft deterrence.

Accordingly, it is desirable to provide a disc mailer that overcomes the deficiencies found in conventional disc mailers, including those discussed above.

SUMMARY OF THE INVENTION

Consistent with the invention, systems and methods are provided for improved two-way disc mailers.

According to one aspect of the invention, a disc mailer is formed of a flexible sheet, comprising first and second panels separated by a predetermined fold line. The first and second panels are adherable to each other to form a pouch for removably holding a disc. The pouch has a slot through which the disc can pass. A third panel is separated from the second panel by a second predetermined fold line to be folded over the slot and adhered to an outer surface of the disc mailer to cover the slot to form a delivery container having a length and a width. A first address area is located on the outer surface of the third panel and is externally visible when the third panel is folded over the slot. The third panel may comprise a lighter paper stock than the first and second panels. A perforation on the third panel opens the disc mailer to access the disc from the pouch. The perforation allows detachment of the first address area from the disc mailer.

Both the foregoing general description and the following detailed description are exemplary and explanatory only, and are not restrictive of the invention.

DESCRIPTION OF EMBODIMENTS

Reference will now be made in detail to the exemplary embodiments of the invention, examples of which are illustrated in the accompanying drawings. Wherever possible, the same reference numbers will be used throughout the drawings to refer to the same or like parts.

Figure 1:
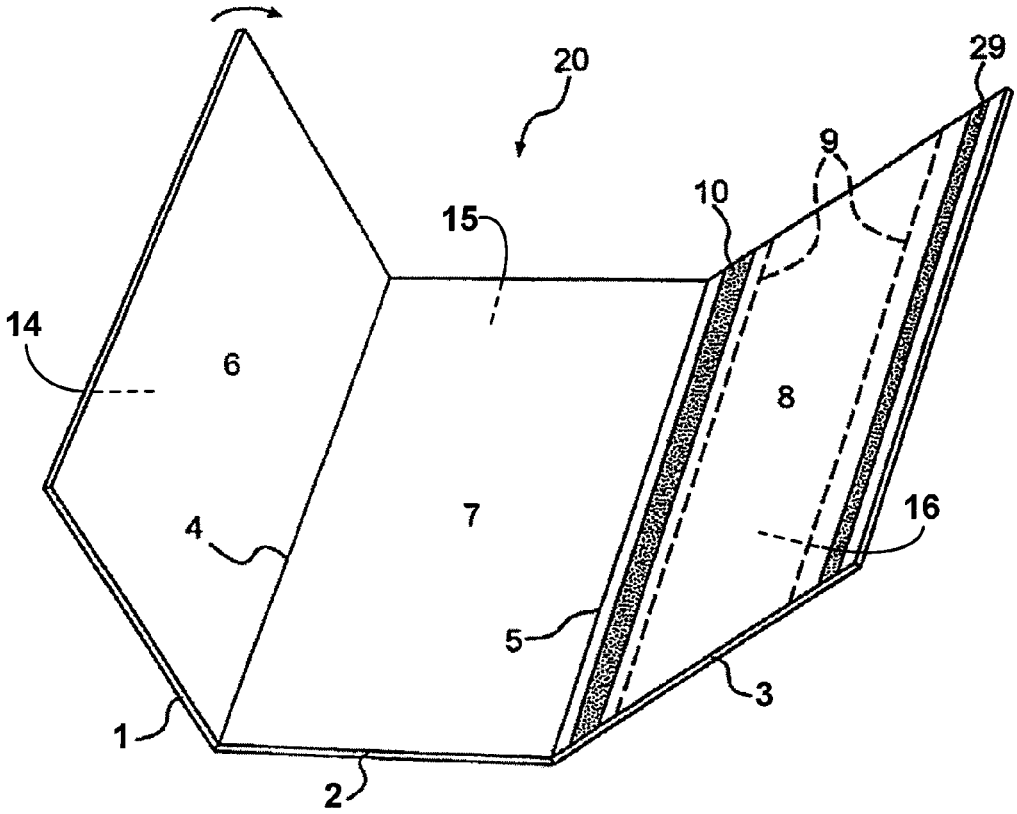
FIG. 1 illustrates a perspective view of a mailer consistent with disclosed embodiments, prior to being folded and adhered to create the finished mailer.
Figure 2:
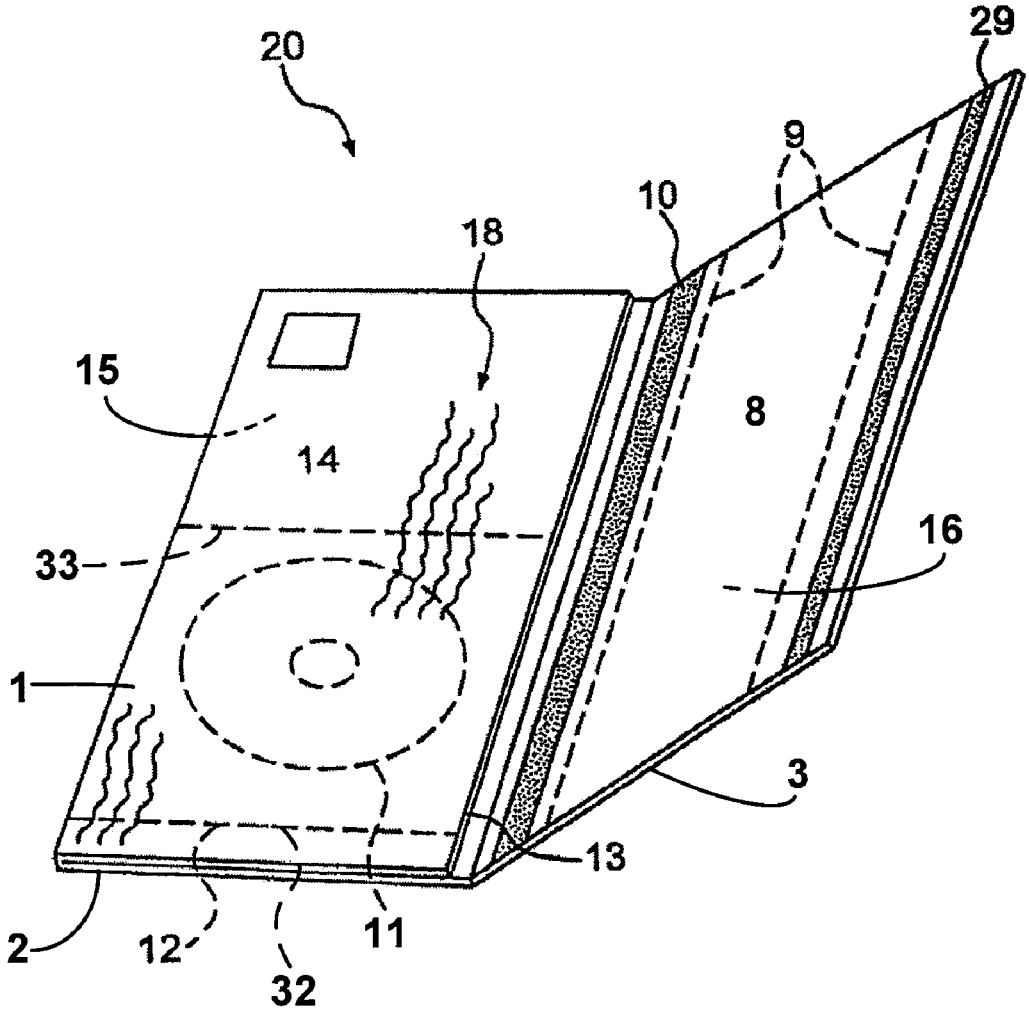
FIG. 2 illustrates a folded and adhered mailer of FIG. 1, the dotted lines representing the intended position of a pouch and a digital disc within the pouch.
Figure 3:
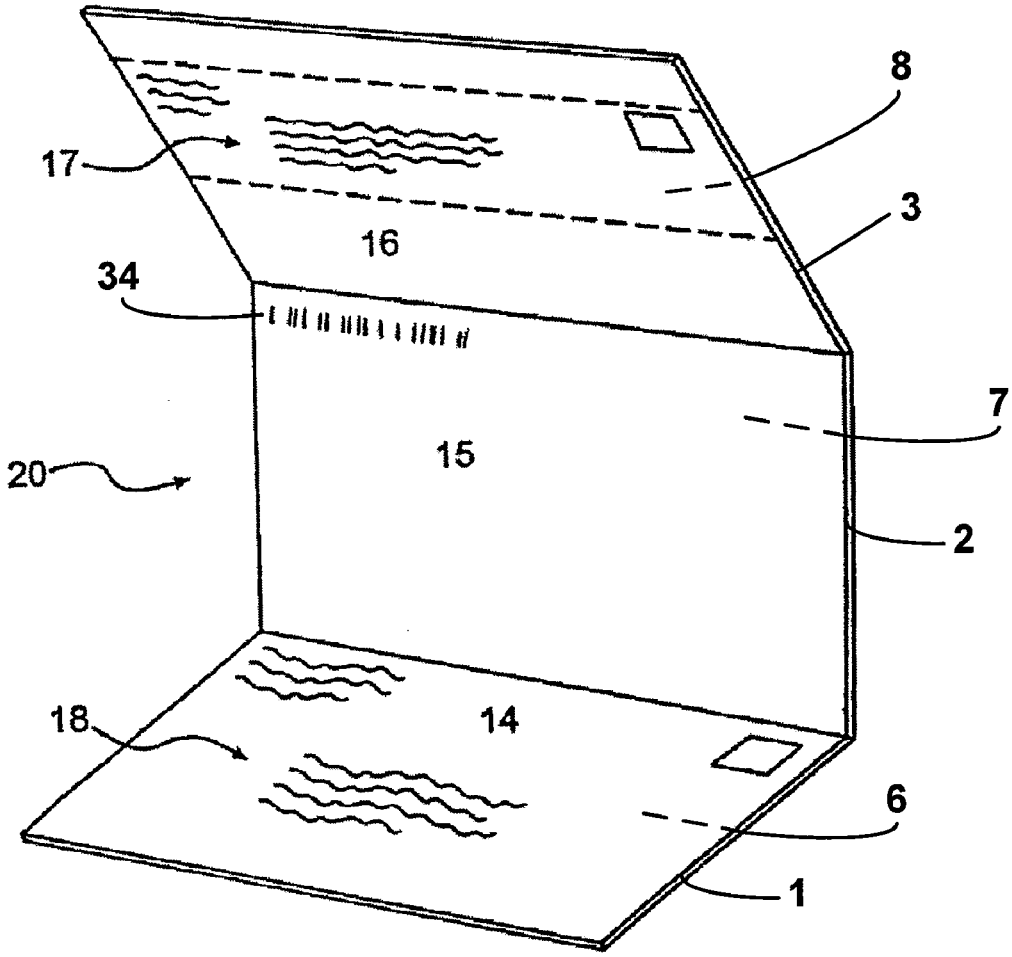
FIG. 3 illustrates a reverse side of the mailer of FIG. 1.

A two-way disc mailer 20 is illustrated in FIGS. 1-3. Disc mailer 20 is designed to permit a disc 11 (FIG. 2) to be shipped to a first recipient (e.g., from a DVD rental company to a customer), whereby the first recipient can remove the disc 11 for viewing or other use. After the first recipient views or uses disc 11, the first recipient can forward disc 11 to a second recipient (e.g., back to the DVD rental company) using the same disc mailer 20.

In an exemplary embodiment, disc mailer 20 comprises a flexible sheet of, for example, cardboard or other paper stock that is folded along a first predetermined line 4 (FIG. 1) to form a left panel 1 and a center panel 2. Inner surface 6 of the left panel 1 is folded along line 4 toward inner surface 7 of center panel 2 to form a volume for holding disc 11. Inner surface 6 can be glued or otherwise attached to inner surface 7, for example along lines 32 and 33 (FIG. 2), to form a pouch 12, including a slot 13. A disc 11 can be removably inserted into pouch 12 via slot 13 that is formed between left panel 1 and center panel 2 and between lines 32 and 33.

A line 5 separates center panel 2 and right panel 3. When right panel 3 and center panel 2 are separate pieces, line 5 represents, for example, a glue or other adhesive line.

After a disc 11 is inserted into pouch 12, inner surface 8 (FIG. 1) of the right panel 3 is folded along or adjacent line 5 toward an outer surface 14 (FIG. 2) of left panel 1, thereby covering slot 13 to secure disc 11 for mailing to the first recipient. Glue or other adhesive is preferably applied to an outer periphery 29 of inner surface 8 of right panel 3. After left panel 1 is folded to cover center panel 2, right panel 3 (which is greater in width than left panel 1) can be folded along a line 9 closest to periphery 29 to wrap around the mailer and secure inner surface 8 to outer surface 15 of center panel 2, thereby causing right panel 3 to completely cover outer surface 14 of left panel 1. Adhesive is preferably also supplied, for example, along an adhesive strip 10 of inner surface 8 of right panel 3, but adhesive strip 10 is not activated for adherence until the mailer is used to send the disc to the second recipient, as explained below.

Preferably, when inner surface 8 of right panel 3 is adhered with adhesive to outer surface 15 of center panel 2, a first recipient's address 17 (FIG. 3), which is printed on an outer surface 16 of right panel 3, is visible, whereas a second recipient's address 18, which is printed on outer surface 14 of left panel 1 is not visible. Accordingly, only the first recipient's address 17 appears on disc mailer 20 when a disc 11 is mailed to the first recipient. The other side of the disc mailer displays outer surface 15 of center panel 2, which has no printed address and may contain, for example, an advertisement or graphic design.

When a disc 11 is shipped to a first recipient in a two-way mailer of the above-described embodiment, the first recipient can open disc mailer 20 by removing part of right panel 3 from disc mailer 20 by, for example, tearing along perforations 9. The area of right panel 3 between perforations 9 is not adhered to center panel 2, which allows for easy removal. Once this part of right panel 3 is removed, and because adhesive strip 10 is not initially adhered to other panels, the first recipient can unfold the remaining part of right panel 3 to access disc 11 from slot 13.

After the first recipient views or otherwise uses disc 11, the first recipient inserts disc 11 back into pouch 12 in preparation for mailing disc 11 and disc mailer 20 to the second recipient. Once disc 11 is in pouch 12, the first recipient activates adhesive strip 10 (for example, by moistening) and permanently adheres the remaining portion of inner surface 8 of right panel 3 to outer surface 14 of left panel 1. Adhesive strip 10 may, of course, be activated by other means, for example, by removing a peel-away strip that covers adhesive strip 10. The first recipient's address 17 was removed when the first recipient detached part of right panel 3 between perforations 9. After adhering strip 10 to left panel 1, the second recipient's address 18 appears on disc mailer 20 and is no longer obstructed by right panel 3. The disc 11 can now be mailed to the second recipient.

Figure 4:
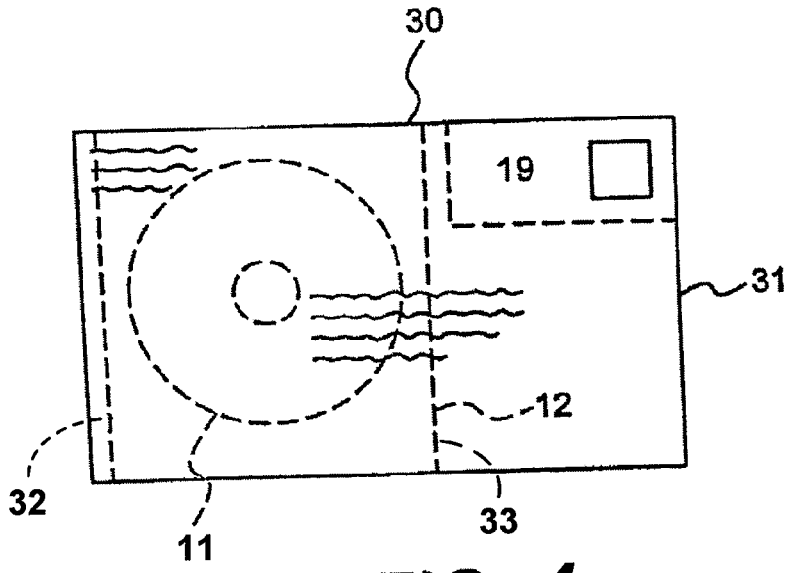
FIG. 4 illustrates the mailer of FIG. 1, prepared for shipment to a first recipient.
Figure 5:
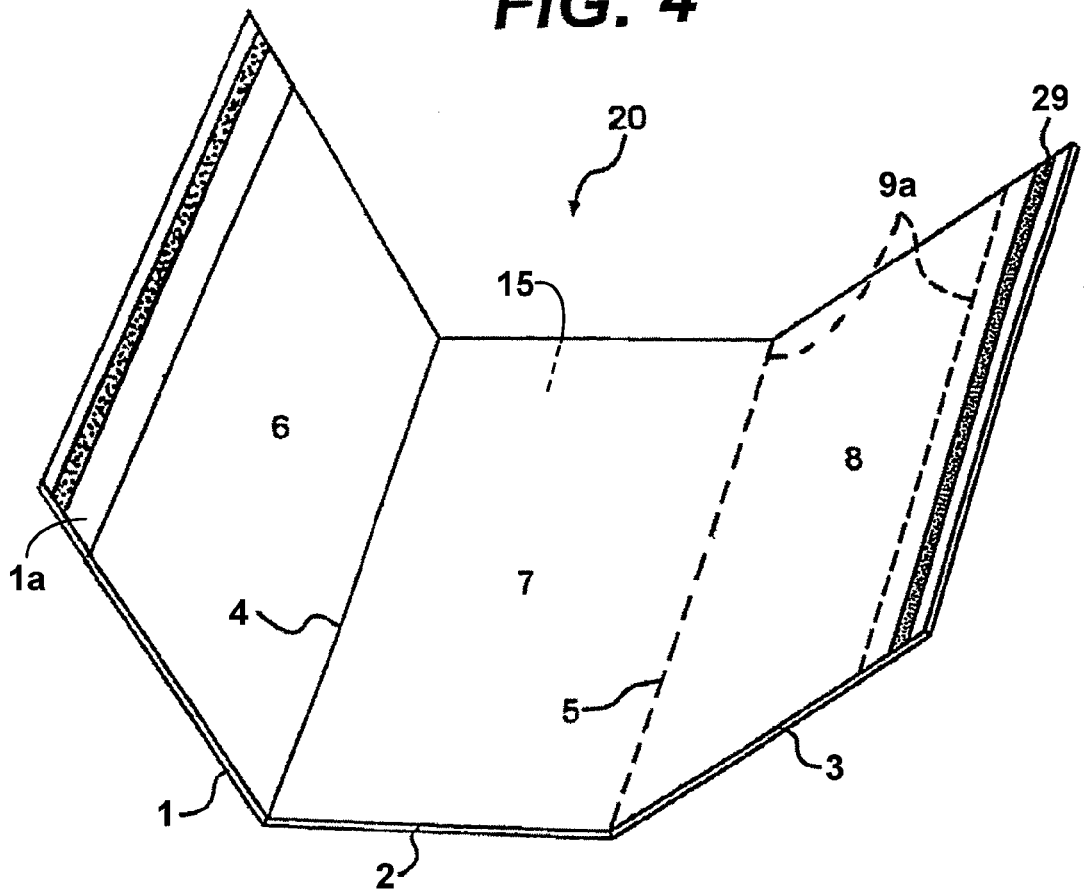
FIG. 5 illustrates a perspective view of an alternative embodiment of a mailer consistent with disclosed embodiments, prior to being folded and adhered to create the finished mailer.

An alternative embodiment is illustrated in FIG. 5. Disc mailer 20 can be opened by the first recipient along perforations 9*a*, which preferably removes most of right panel 3. In this embodiment, the width of panel 1 (left) is greater than the width of panel 3 (right). Once a disc 11 is in the pouch (FIG. 4) for mailing to the second recipient, the first recipient covers slot 13 to secure the disc in pouch 12 by folding and permanently adhering an extended portion 1*a* (FIG. 5) of left panel 1 to outer surface 15 of center panel 2. This embodiment is advantageous because, if an initial ID tag 34 (illustrated, for example, in FIG. 3) is located on outer surface 15, the extended portion 1*a* of left panel 1 covers the initial ID tag, thus preventing possible delays during return processing to the second recipient. The extended portion 1*a* of left panel 1 can be provided as an alternative to the remaining portion of the right panel that has an adhesive strip 10 discussed above.

FIG. 4 illustrates how the two-way disc mailers of the present invention can optionally bias a disc 11 away from cancellation area 19. Lines 32 and 33, which demark the outer bounds of pouch 12 and limit movement of disc 11 in the left and right direction according to FIG. 4, are suitably offset from cancellation area 19. More specifically, it is line 33 that prevents disc 11 from entering cancellation area 19. As previously discussed, disc mailer 20 may be canceled anywhere in cancellation area 19, which is from about 100 mm from right edge 31 of disc mailer 20 to about 30 mm from top edge 30 of disc mailer 20. Thus, line 33 is preferably located at least about 100 mm from right edge 31 of disc mailer 20. Biasing disc 11 in this manner reduces the risk of damage to disc 11 during cancellation.

The position of pouch 12 within the mailer is essentially dictated by placement of lines 32 and 33 along the length of the mailer. Pouch 12, and therefore disc 11, may be positioned either to the left side of the mailer (as illustrated), or can be place more centrally in the mailer (not shown). This is accomplished by shifting the location of lines 32 and 33 along the length of the mailer. Central placement of the disc allows the mailer to move more stably through the processing equipment. For mailers of certain dimensions, a more central placement of the disc can also prevent the extra length of the mailer in the cancellation area from folding. Such folding may cover information required for processing the mail piece, resulting in unnecessary delays.

Additionally, an exemplary embodiment of disc mailer 20 enables a disc 11 to be mailed with first-class postage rates. First class postage rates apply if the total weight of the mailer is less than or equal to 1 ounce. Accordingly, because discs weigh approximately less than or equal to 0.62 ounce, a preferred embodiment of disc mailer 20 weighs less than or equal to 0.38 ounce. In this embodiment and when weighed together with a disc 11, disc mailer 20 will weigh less than or equal to 1 ounce and qualify for first-class postage rates.

Additionally, in an exemplary embodiment of the disc mailer 20, the predetermined lines 4 and 5 (FIG. 1), are substantially parallel to the longer dimension of the envelope (e.g., top edge 30 (FIG. 4)). This minimizes chances that disc mailer 20 might become damaged or otherwise opened during the automatic mail processing.

Also in an exemplary embodiment of disc mailer 20, left panel 1 and center panel 2 comprise a heavier paper stock than right panel 3. This allows the disc mailer to utilize a heavier card stock for the panels 1, 2 that are used for its second mailing (after right panel 3 has been removed) while still remaining within first class postage weight limits. For example, left panel 1 and center panel 2 can comprise a paper stock of heavier than 24-pound craft paper, which provides improved resistance to bending while keeping the mailer within first-class postage rate weight limitations. Panel 3 may then comprise, for example, a paper stock of 24-pound or lighter craft paper. Alternatively, left panel 1 and center panel 2 may be formed of a suitable stock white woven paper, which is generally easier to print on than regular craft paper. Right panel 3 may then comprise a lighter stock of white woven paper.

In another exemplary embodiment, the disc mailer 20 comprises opaque paper. Using opaque paper eliminates the need for security printing, which is used for maintaining the confidentiality of the contents of mailer.

In an exemplary embodiment of the disc mailer 20, the predetermined lines 4, 5 are substantially parallel to the grain of the flexible sheet. This strengthens the mailer along lines 4, 5, thus minimizing the chance that the mailer might become damaged or otherwise opened during automatic mail processing.

In an exemplary embodiment of the two-way disc mailer 20, the inner surface 8 of the right panel 3 may comprise advertising material and coupons. In particular, coupons may be printed on the inner surface 8 of the right panel 3 between the perforations 9.

It will be apparent to those skilled in the art that various modifications and variations can be made to the structure and methodology of the present invention without departing from the scope or spirit of the invention. Thus, it should be understood that the invention is not limited to the examples discussed in the specification. Rather, the present invention is intended to cover modifications and variations of this invention.

What is claimed is:

1. A disc mailer formed of at least one flexible sheet, comprising:

first and second panels separated by a predetermined fold line, the first and second panels adherable to each other to form a pouch for removably holding a disc, the pouch having a slot through which the disc can pass;

a third panel, attached to the second panel, foldable over the slot and adherable to an outer surface of the disc mailer to cover the slot to form a delivery container having a length and a width;

a first address area on the outer surface of the third panel that is externally visible when the third panel is folded over the slot; and a perforation on the third panel for opening the disc mailer to access the disc from the pouch, the perforation allowing detachment of the first address area from the disc mailer, wherein the predetermined fold lines are substantially parallel to the length of the disc mailer and the third panel comprises a lighter paper stock than the first and second panels.

2. The disc mailer of claim 1, comprising a second address area on the outer surface of the second panel that is covered when the third panel is folded over the slot.

3. The disc mailer of claim 1, wherein the disc mailer has a weight of less than or equal to about 0.38 ounce.

4. The disc mailer of claim 1, wherein the disc in the pouch is positioned away from the cancellation area.

5. The disc mailer of claim 1, wherein the disc in the pouch is positioned at least about 100 mm from a right edge of the disc.

6. The disc mailer of claim 1, wherein the flexible sheet comprises craft paper.

7. The disc mailer of claim 1, wherein the flexible sheet comprises white woven paper.

8. The disc mailer of claim 1, wherein the flexible sheet comprises opaque paper.

9. The disc mailer of claim 1, wherein the flexible sheet has a grain and the first and second predetermined fold lines are substantially parallel to the grain.

10. A disc mailer, comprising:

a flexible sheet of a first paper stock foldable along predetermined lines to form a left panel and a center panel, each having an inner surface and an outer surface, the inner surface of the left panel being foldable toward the inner surface of the center panel and adherable thereto along predetermined lines to form a pouch for removably holding a disc, the pouch having a slot for removing the disc;

a right panel of a second paper stock, lighter than the first paper stock, attached to the center panel and having an inner surface and an outer surface, the inner surface of the right panel being foldable over the slot and adherable to an outer surface of the disc mailer to cover the slot to form a delivery container having a length and a width, and comprising a detachable a first address area on the outer surface of the right panel that is externally visible when the right panel is folded over the slot;

a perforation on the right panel for opening the disc mailer and detaching the first address area from the right panel of the disc mailer, so as to permit removal of the disc from the pouch via the slot;

a second address area on the outer surface of the left panel that is externally visible when the first address area has been detached from the mailer; and an adhesive on the inner surface of the right panel for adhering the inner surface of the right panel to the left panel to cover the slot and secure the disc in the pouch when the first address is detached.

11. The disc mailer of claim 10, wherein the disc mailer has a weight of less than or equal to about 0.38 ounce.

12. The disc mailer of claim 10, wherein the predetermined lines are substantially parallel the length of the disc mailer.

13. The disc mailer of claim 10, wherein the disc in the pouch is positioned at least about 100 mm from a right edge of the disc mailer.

14. The disc mailer of claim 10, wherein the flexible sheet comprises craft paper.

15. The disc mailer of claim 10, wherein the flexible sheet comprises white woven paper.

16. The disc mailer of claim 10, wherein the inner surface of the right panel comprises advertising material.

17. The disc mailer of claim 10, wherein the right panel comprises about two perforations and the inner surface of the right panel comprises a coupon located between the perforations.

18. The disc mailer of claim 10, wherein the flexible sheet comprises opaque paper.

19. The disc mailer of claim 10, wherein the inner surface of the left panel is glued to the inner surface of the center panel to form the pouch.

20. The disc mailer of claim 10, wherein the adhesive adheres the inner surface of the folded right panel to close the slot and cover an initial ID tag.

21. The disc mailer of claim 10, wherein the flexible sheet has a grain and the predetermined lines are substantially parallel to the grain.

22. A mailer comprising:

a flexible sheet of a first paper stock foldable along predetermined lines to form a left panel and a center panel, each having an inner surface and an outer surface the inner surface of the left panel being foldable toward the inner surface of the center panel and adherable thereto along predetermined lines to form a pouch for removably holding a disc, the pouch having a slot for removing the disc;

a right panel of a second paper stock, lighter than the first paper stock, having an inner surface and an outer surface and attached to the center panel, an inner surface of the right panel being foldable over the slot and adherable to an outer surface of the disc mailer to cover the slot to form a delivery container having a length and a width, and comprising a detachable first address area on an outer surface of the right panel that is externally visible when the right panel is folded over the slot;

a second address area on the outer surface of the left panel that is externally visible when the first address area has been detached from the mailer;

a perforation on the right panel for opening the disc mailer and detaching the first address area from the right panel of the disc mailer, so as to permit removal of the disc from the pouch via the slot; and the left panel having an extended portion, the extended portion adherable on its inner surface to an outer surface of the center panel to cover the slot and secure the disc in the pouch.

23. The disc mailer of claim 22, wherein the disc mailer has a weight of less than or equal to about 0.38 ounce.

24. The disc mailer of claim 22, wherein the predetermined lines are substantially parallel to the length of the disc mailer.

25. The disc mailer of claim 22, wherein the disc in the pouch is positioned at least about 100 mm from a right edge of the disc mailer.

26. The disc mailer of claim 22, wherein the flexible sheet comprises craft paper.

27. The disc mailer of claim 22, wherein the flexible sheet comprises white woven paper.

28. The disc mailer of claim 22, wherein the inner surface of the right panel comprises advertising material.

29. The disc mailer of claim 22, wherein the right panel comprises about two perforations and the inner surface of the right panel comprises a coupon located between the perforations.

30. The disc mailer of claim 22, wherein the flexible sheet comprises opaque paper.

31. The disc mailer of claim 22, wherein the inner surface of the left panel is glued to the inner surface of the center panel to form the pouch.

32. The disc mailer of claim 22, wherein the adhesive adheres the extended portion of the left panel to close the slot and cover an initial ID tag.

33. The disc mailer of claim 22, wherein the flexible sheet has a grain, and the predetermined lines are substantially parallel to the grain.

* * * * *